US005332264A

United States Patent [19]

Chiarella

[11] Patent Number: 5,332,264

[45] Date of Patent: Jul. 26, 1994

[54] BOOK PULL TAB WITH RETRACTABLE GRIPPING MEMBER

[76] Inventor: Joseph Chiarella, 111 Herman Ave., Lemoyne, Pa. 17043-1936

[21] Appl. No.: 18,182

[22] Filed: Feb. 16, 1993

[51] Int. Cl.[5] ..... B42D 3/00

[52] U.S. Cl. ..... 281/51

[58] Field of Search ..... 281/15.1, 32, 29, 36, 281/43, 51; 229/117.23, 117.09

[56] References Cited

U.S. PATENT DOCUMENTS 2,465,616 3/1949 Sziklai ..... 281/32

3,514,875 6/1976 Howard ..... 281/19.1

4,306,736 12/1981 Cournover et al. ..... 281/43

4,679,823 7/1987 Nagy ..... 281/43

5,197,761 3/1993 Shirdavani ..... 281/51 X

*Primary Examiner*—Mark Rosenbaum

*Assistant Examiner*—Willmon Fridie, Jr.

*Attorney, Agent, or Firm*—Thomas Hooker

[57] ABSTRACT

The base of a pull tab is adhesively attached to the spine of a book. The tab includes a U-shaped grip connected to the base by a pair of hinges and is rotated between an extended position located within the base and a pull position extending outwardly from the base.

19 Claims, 3 Drawing Sheets

BOOK PULL TAB WITH RETRACTABLE GRIPPING MEMBER

FIELD OF THE INVENTION

This invention relates to pull tabs attached to books, folders and the like which are gripped to aid in the withdrawal of the book or folder from storage.

DESCRIPTION OF THE PRIOR ART

Books, such as textbooks or notebooks, are typically stored on shelves, side-by-side in horizontal rows. The shelves may be oriented singly or grouped in a bookcase with a number of parallel horizontal shelves. A book is withdrawn from a shelf by gripping the top of the spine of the book and pulling the book outward from between a pair of adjacent books. When books are stored side-by-side on a bookcase between adjacent parallel shelves, the length of the spine of a book may be only be slightly less than the distance separating the parallel shelves, making gripping the spine and removal of the book from the shelf difficult.

Books are also stored in protective open slipcases. The slipcase enshrouds the book with the spine of the book coplanar with the open edge of the slipcase. The slipcase may include a semi-circular recess along each side of the open edge of the slipcase. The cover of the book may be gripped through the recesses thereby aiding in the removal of the book from within the slipcase. However, when the slipcases are stored side-by-side in horizontal rows, the recesses are covered by adjacent slipcases and inaccessible, making removal of books from the slipcase difficult.

SUMMARY OF THE INVENTION

The present invention is a retractable pull tab which may be affixed to the spine of a book to aid in the withdrawal of the book from between adjacent books in a horizontal row or from within a slipcase. The pull tab includes a grip which is hingeably joined to the front of a flat base. U-shaped inner and outer concentric cut lines extend through the body of the base and define the grip. The grip hingeably joins the base between the ends of the cut lines and is readily rotated between a retracted position, where the grip is coplanar with the base, and an extended position, where the grip is perpendicular to the base. The grip has a tight friction fit between the two concentric cut lines when rotated to the retracted position. This friction fit maintains the grip in the retracted position when not in use.

A slot is included in the pull tab base adjacent the center of the outer cut line. When the pull tab is in the retracted position, a fingernail or small instrument may be extended to the slot and behind the grip to move the grip out from the retracted position to a position where it is easily grasped and may be pulled to remove the book from storage.

The base includes an elongate finger in the center of the base inside the inner cut line. The back of the base, including the finger, are covered with an adhesive which holds the base of the pull tab to the spine of a book. When the grip is pulled, the adhesion of the finger to the spine prevents the center of the base of the pull tab from separating from the spine and also prevents the base from bowing outward along the middle. Bowing of the base undesirably stresses the hinges.

After the book is removed from the horizontal row or slipcase, the grip may be rotated from the extended position to the retracted position allowing the spine of the book to be placed squarely on a support surface without the tab interfering with use of the book.

Other objects and features of the invention will become apparent as the description proceeds, especially when taken in conjunction with the accompanying drawings illustrating the invention, of which there are three sheets and one embodiment.

DESCRIPTION OF THE PREFERRED EMBODIMENT

Figure 2:
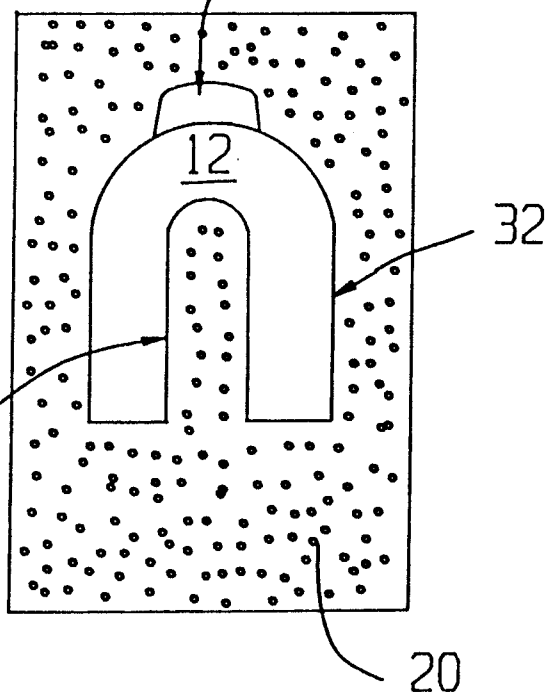
FIG. 2 is a back view of the pull tab of FIG. 1.

Pull tab 10 has a U-shaped elongate gripping member 12 integrally joined to rectangular flat base 14 at a pair of hinges 28. The grip is rotatable between an extended position where the grip is perpendicular to the base and a retracted position where the grip and base are coplanar. The pull tab is affixed to spine 18 of book 16 by adhesive 20 which covers the back of base 14. The pull tab may also be affixed to the spine of the book by rivets (not shown) or other conventional mounting means. Plastic pull tab 10 is manufactured cheaply and easily from flat sheets of thermoplastic material using a conventional stamping process. The plastic may be polypropylene.

Figure 3:
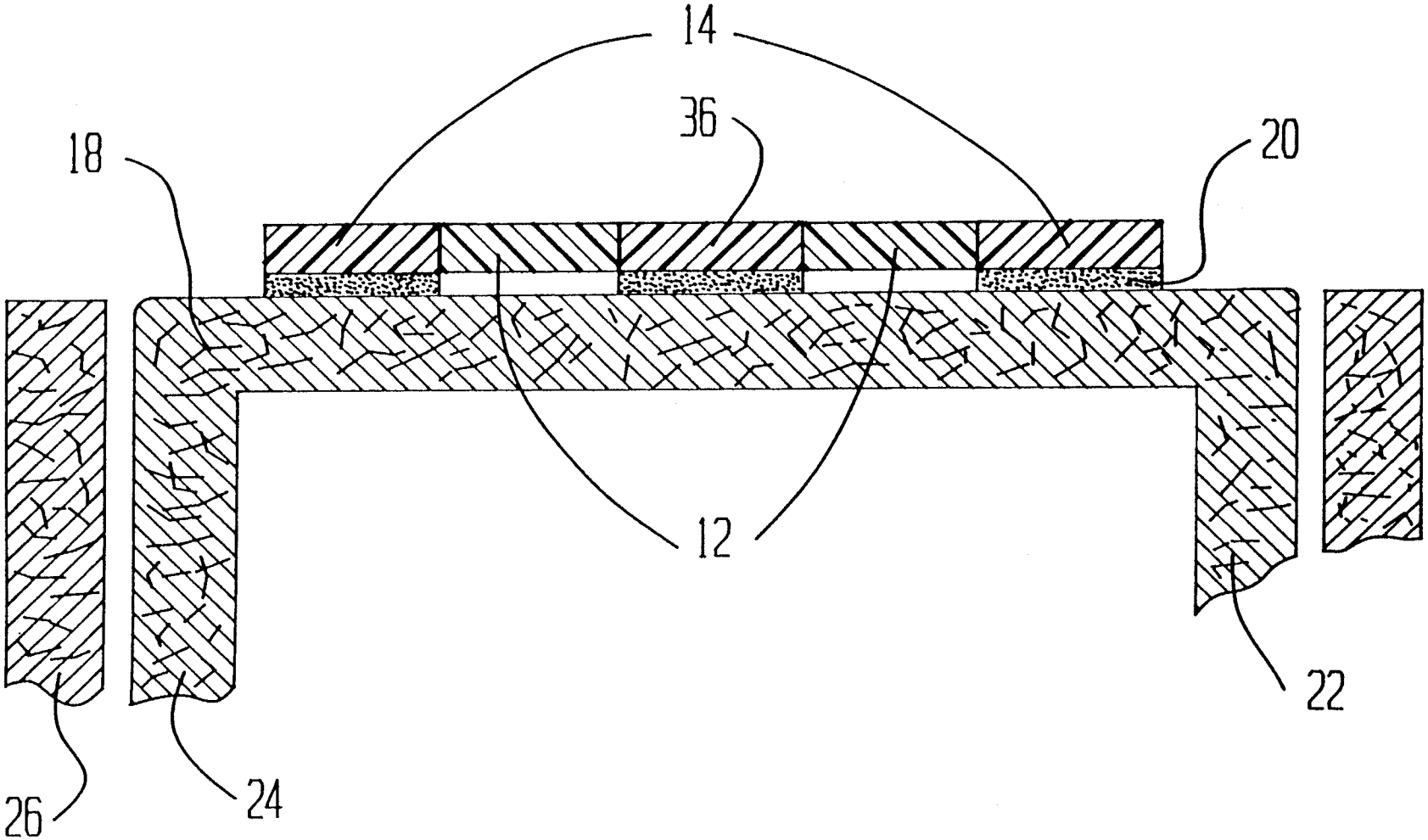
FIG. 3 is a sectional view, partially broken away, taken along line 3—3 of FIG. 1.
Figure 4:
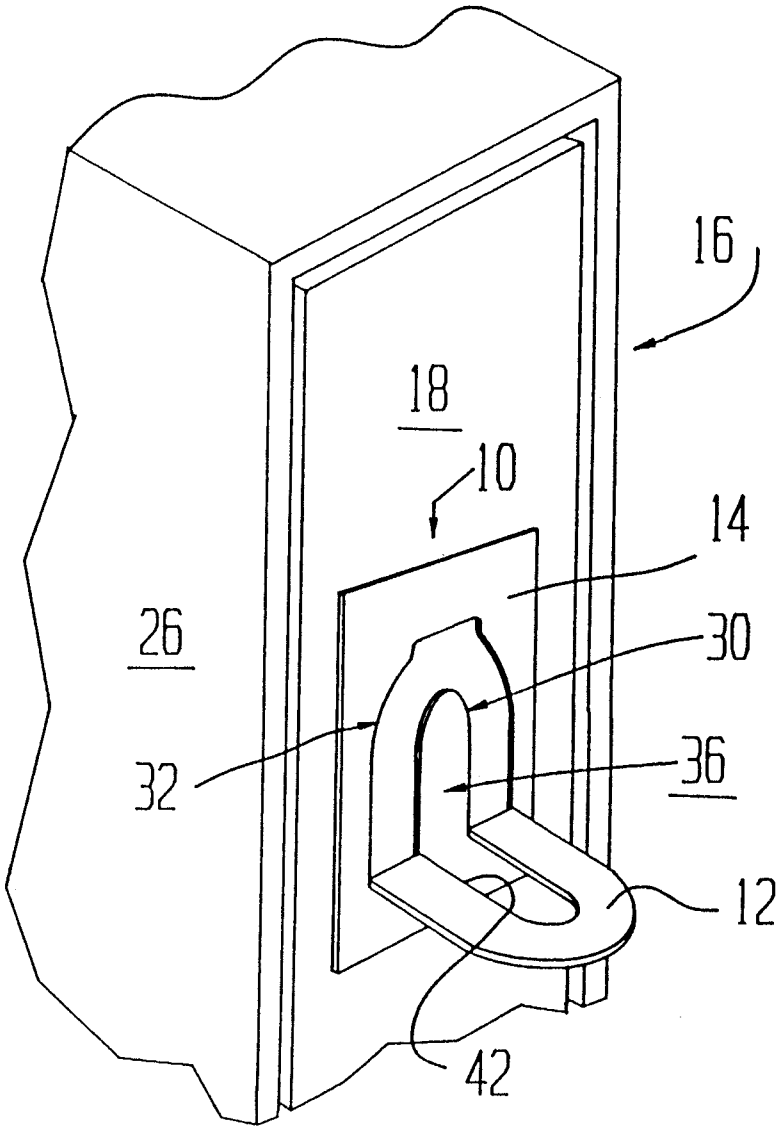
FIG. 4 is an isometric view, partially broken away, of the pull tab affixed to the spine of a book with the grip in the extended position.

Book 16 has front cover 22 and back cover 24 which are joined by spine 18. As shown in FIG. 3, the book is stored within slipcase 26 which is parallelopiped lacking one face. The book stored within the slipcase is typically a loose-leaf notebook, however, it is contemplated that the pull tab may be affixed to other books, binders, or non-books as required.

Figure 1:
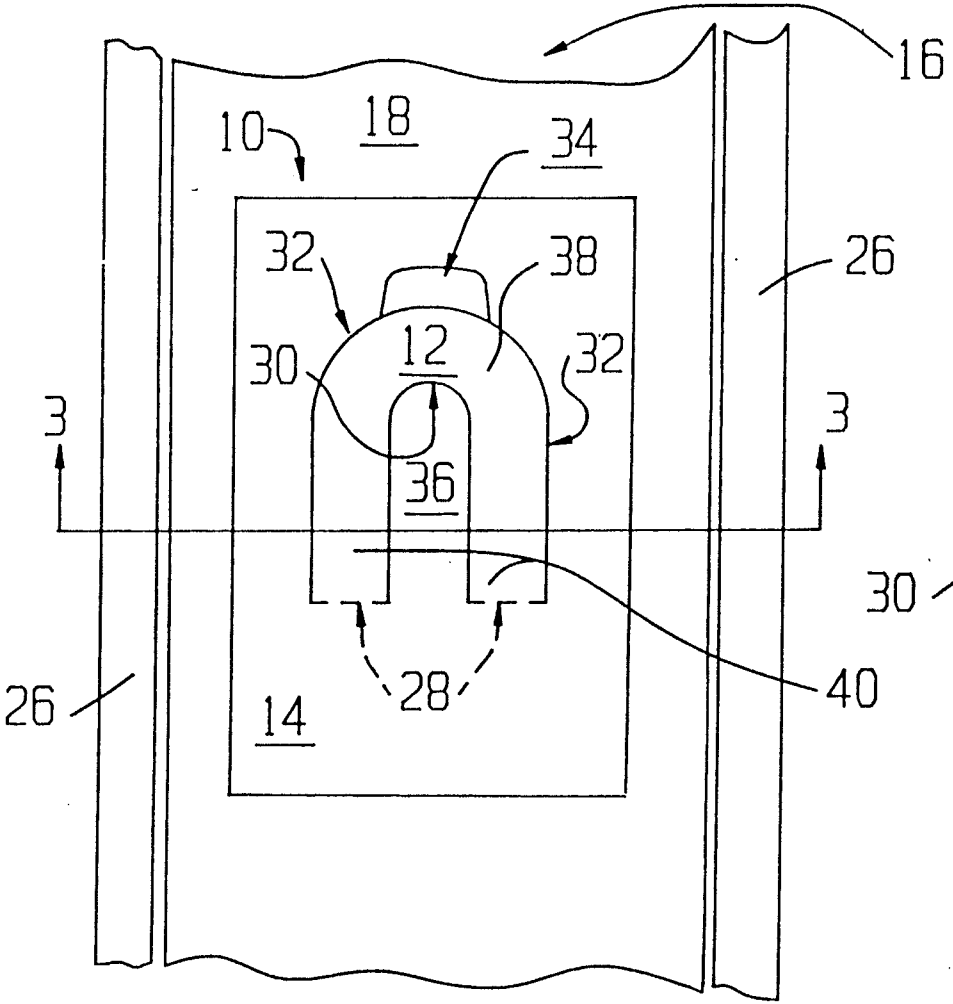
FIG. 1 is a front view, partially broken away, of the pull tab affixed to the spine of a book with the grip in the retracted position.

Concentric U-shaped inner and outer cut lines 30 and 32 are formed in the center of base 14. The cut lines define a U-shaped grip 12. Grip 12 has a curved top 38 adjacent slot 34 as shown in FIG. 1, and a pair of legs 40 extending from the ends of the top to hinges 28 between the inner and outer cut lines. When the grip is in the retracted position, the grip is fitted between outer cut line 32 and inner cut line 30 and held in place by a tight frictional engagement with the base at the cut lines. This fit maintains the grip in the retracted position when the grip is not in use. The lateral and longitudinal dimensions of the pull tab base and grip may be varied in order to accommodate a book with a narrow spine or a wide spine.

A cut-out slot 34 is formed in the base at the top of the grip on the outer cut line 32. The tip of a fingernail or a small instrument may be inserted within opening 34 behind the grip to pry the grip from the retracted position.

Base 14 includes finger 36 located at the middle of the base within inner cut line 32. As shown in FIG. 2, adhesive 20 covers the back of finger 36 and base 14 but does not cover the grip. The adhesion between the finger and the spine of the book prevents the center of the base from bowing outward away from the spine, when the grip is pulled. The adhesive may be a cut-out portion of a double-sided adhesive tape applied to the back of the base.

Before the base of the pull tab is affixed to the spine of a book, a protective layer on the adhesive tape is peeled away from the back of the base to expose adhesive 20 covering the base including the finger. The pull tab may be affixed to the spine at any location along the length of the spine. The pull tab is placed on the spine and then pressure is applied to the front of the base to affix the base of the pull tab to the spine.

When it becomes necessary to remove book 16 from slipcase 26, the tip of a fingernail or a small instrument is inserted within slot 34 behind the top of the retracted grip 12. The fingernail or instrument pries the grip from the retracted position causing the grip to rotate about hinges 28 out from the base. The grip is then moved to the full extended position and pulled, withdrawing the book from within the slipcase. The same steps would be repeated if the book was to be withdrawn from between adjacent books which are not stored in a slipcase. The pull recess 42 in the U-shaped grip 12 facilitates holding the grip and withdrawing the book.

While pull tab 10 is particularly useful affixed to the spines of books and binders, it may also be affixed to other surfaces as required. For instance, the pull tab may be mounted on drawers or movable shelves to facilitate movement of the drawers or shelves.

While I have illustrated and described a preferred embodiment of my invention, it is understood that this is capable of modification, and I therefore do not wish to be limited to the precise details set forth, but desire to avail myself of such changes and alterations as fall within the purview of the following claims.

What I claim as my invention is:

1. The combination of a book having a front cover, a back cover and a spine joining the covers and a pull tab affixed to the spine, the pull tab including a base having a front surface and a back surface, a mounting means for bonding the back surface of the base to the spine, a flat U-shaped grip member having a top and two legs extending away from the top, said legs being spaced apart from each other to define a pull recess between the legs to facilitate manual engagement of the grip and movement of the book from a storage position, a pair of hinges integrally joining the ends of said legs away from the top of the grip member to said base, said base including a finger located between the legs of said U-shaped grip, a U-shaped cut out recess formed within the base conforming to the shape of the grip member, said grip member being movable about said hinges from a retracted position in which the grip member is positioned within the flat base with the edges of the grip member frictionally engaging the sides of the U-shaped cutout to retain the grip member in place and an extended position in which the grip member is rotated about said hinges away from the base.

2. The combination of claim 1 wherein the mounting means is an adhesive.

3. The combination of claim 1 wherein the mounting means is a plurality of rivets.

4. The combination of claim 1 including a slot formed in the base between the U-shaped cut out and the top of the grip member when the grip is in the retracted position, said slot facilitating rotation movement of the grip member about said hinges away from the base.

5. The combination of claim 4 wherein the top of the grip member and the free end of the finger are both rounded.

6. The combination of claim 4 wherein the base and finger are flat.

7. The combination of claim 6 wherein the base and grip are formed from a sheet of thermoplastic material.

8. The combination of claim 7 wherein the base is rectangular and a pair of opposed sides of the base parallel the legs.

9. A pull tab comprising a flat base, a grip, the base and grip being integrally formed from a sheet of thermoplastic material, the base having a front surface and a back surface, an adhesive covering the back surface of the base, a U-shaped cutout recess formed in the base, the recess having an opposed top and bottom, said grip being U-shaped and having an opposed top and bottom, hinge means integrally formed from said sheet for joining the bottom of the grip to the base at the bottom of the recess and for permitting rotation of the grip from a retracted position within the recess to an extended position projecting outwardly from the front surface of the base, a friction engagement fit between the edges of the grip and the edges of the recess when the grip is in the retracted position, and an opening in the interface between the top of the grip and the top of the recess to facilitate initial movement of the grip outwardly from the retracted position.

10. A pull tab as in claim 9 including engagement means the grip for facilitating pulling of the grip in a direction away from the base.

11. A pull tab as in claim 10 wherein said base includes a finger located within the recess, an adhesive covering the back surface of the finger, said grip including a pair of legs, and said hinge means comprises a hinge at the end of each leg joining the leg to the base.

12. A pull tab as in claim 11 wherein the top of the grip is rounded and said opening is located at the center of the top of the grip.

13. A pull tab as in claim 12 wherein said base is rectangular and a pair of opposed edges parallel said legs.

14. A pull tab including:

A) a flat base having a front and a back, an adhesive substance covering the back, and a recess having a top and a bottom;

B) a retractable grip having a top and a bottom, hinge means for hingeably attaching the bottom of the grip to the bottom of the recess to permit rotation of the grip between a retracted position where the grip and base are coplanar and an extended position where the grip is perpendicular to the base; and C) an opening in the base for receiving an instrument for moving the grip from the retracted position.

15. The combination of a pull tab of claim 14 and a book having a front cover and back cover joined by a spine wherein the adhesive adheres the pull tab to the spine of the book.

16. The pull tab of claim 14 wherein the grip is U-shaped with legs and the flat base includes a pair of slits extending through the base, one within the other to define the grip.

17. The pull tab of claim 16 wherein the slits are concentric.

18. The pull tab of claim 16 wherein the opening is adjacent the outer slit.

19. The pull tab of claim 16 wherein the base includes an elongate finger adjacent the inner slit.

* * * * *

UNITED STATES PATENT AND TRADEMARK OFFICE

CERTIFICATE OF CORRECTION

PATENT NO. : 5,332,264

DATED : July 26, 1994

INVENTOR(S) : Joseph Chiarella

It is certified that error appears in the above-identified patent and that said Letters Patent is hereby corrected as shown below:

Claim 10, line 2, (column 4, line 29), after "means", insert --on--.

Signed and Sealed this

Twentieth Day of September, 1994

*Attest:*

*Attesting Officer*

BRUCE LEHMAN

*Commissioner of Patents and Trademarks*